US007976403B2

(12) United States Patent
Gilbert et al.

(10) Patent No.: US 7,976,403 B2
(45) Date of Patent: Jul. 12, 2011

(54) MUSCLE-BACK IRON GOLF CLUBS WITH HIGHER MOMENT OF INERTIA AND LOWER CENTER OF GRAVITY

(75) Inventors: Peter J. Gilbert, Carlsbad, CA (US); Douglas C. Jorgensen, San Diego, CA (US)

(73) Assignee: Acushnet Company, Fiarhaven, MA (US)

( * ) Notice: Subject to any disclaimer, the term of this patent is extended or adjusted under 35 U.S.C. 154(b) by 0 days.

(21) Appl. No.: 12/546,591

(22) Filed: Aug. 24, 2009

(65) Prior Publication Data

US 2009/0318244 A1 Dec. 24, 2009

Related U.S. Application Data

(62) Division of application No. 11/421,135, filed on May 31, 2006, now abandoned.

(51) Int. Cl.
*A63B 53/04* (2006.01)

(52) U.S. Cl. ..... 473/309; 473/349; 473/350

(58) Field of Classification Search ..... 473/290–291, 473/349–350, 309
See application file for complete search history.

(56) References Cited

U.S. PATENT DOCUMENTS

| | | | | |
|---|---|---|---|---|
| 1,444,842 | A * | 2/1923 | Lagerblade | 473/309 |
| 4,420,156 | A | 12/1983 | Campau | |
| 4,687,205 | A * | 8/1987 | Tominaga et al. | 473/348 |
| 4,811,950 | A | 3/1989 | Kobayashi | |
| 4,852,880 | A * | 8/1989 | Kobayashi | 473/349 |
| 4,928,972 | A | 5/1990 | Nakanishi et al. | |
| 4,992,236 | A * | 2/1991 | Shira | 419/28 |
| 5,439,223 | A | 8/1995 | Kobayashi | |
| 5,658,208 | A * | 8/1997 | Shimasaki | 473/349 |
| 5,833,551 | A * | 11/1998 | Vincent et al. | 473/350 |
| 5,885,170 | A * | 3/1999 | Takeda | 473/306 |
| 5,967,903 | A | 10/1999 | Cheng | |
| 6,045,456 | A | 4/2000 | Best et al. | |
| 6,561,921 | B2 * | 5/2003 | Takeda | 473/305 |
| 6,849,005 | B2 * | 2/2005 | Rife | 473/350 |
| 6,860,819 | B2 * | 3/2005 | Gilbert | 473/291 |
| 7,207,899 | B2 * | 4/2007 | Imamoto | 473/332 |
| 7,273,418 | B2 | 9/2007 | Gilbert | |
| 7,316,623 | B2 | 1/2008 | Imamoto | |
| 7,481,719 | B2 * | 1/2009 | Imamoto | 473/332 |
| 2001/0001771 | A1 * | 5/2001 | Peters et al. | 473/291 |
| 2002/0095762 | A1 * | 7/2002 | Takeda | 29/447 |
| 2003/0139225 | A1 * | 7/2003 | Rife | 473/332 |
| 2003/0228928 | A1 | 12/2003 | Yabu | |
| 2003/0236134 | A1 | 12/2003 | Nishitani | |
| 2005/0014573 | A1 * | 1/2005 | Lee | 473/291 |
| 2005/0054458 | A1 | 3/2005 | Chen | |

(Continued)

OTHER PUBLICATIONS

Bridgestone Sports Co., "Tanbec TB-2 Clubs" [online], 2003 [retrieved on May 12, 2006], from http://www.bs-olf.com/topics/2003/comp_iron/g0501_iron_2.html, translated from Japanese by Google (http://translate.google.com).

(Continued)

*Primary Examiner* — Stephen L. Blau
(74) *Attorney, Agent, or Firm* — Michael J. Mancuso

(57) ABSTRACT

Disclosed herein are muscle-back iron golf clubs that have improved mass qualities to provide higher rotational moments of inertia and lower center of gravity while retaining the workability of muscle-back irons and the size, shape and dimensions preferred by tour players and low handicap players.

7 Claims, 10 Drawing Sheets

U.S. PATENT DOCUMENTS

| | | | |
|---|---|---|---|
| 2005/0119066 | A1 | 6/2005 | Stites et al. |
| 2006/0293114 | A1 | 12/2006 | Chen |

OTHER PUBLICATIONS

PGA.com, "Bridgestone Precept EC603 Pro Iron set" [online], 2003 [retrieved on May 12, 2006], from http://valueguide.pga.com/detail.php?brand=2669&product_type=205&model=46162.

Ken's Custom Clubs, "Precept" [online], 2003 [retrieved on May 12, 2006], from http://www.easycart.net/kenscustomclubs/precept.html.

Stogel, C. "Precept new product specs" [online], 2004 [retrieved on May 12, 2006], from http://www.golfweb.com/story/7515028.

Stogel, C. "Precept gets teh pulse of competitive golfers" [online], Jul. 21, 2004 [retrieved on May 12, 2006], from http//www.golfweb.com/story/7515016.

* cited by examiner

MUSCLE-BACK IRON GOLF CLUBS WITH HIGHER MOMENT OF INERTIA AND LOWER CENTER OF GRAVITY

CROSS-REFERENCE TO RELATED APPLICATIONS

The present application is a divisional of U.S. application Ser. No. 11/421,135, filed on May 31, 2006, now abandoned, the contents of which are incorporated herein by reference in their entirety.

FIELD OF THE INVENTION

This invention generally relates to golf clubs, and, more particularly, to muscle-back iron-type clubs.

BACKGROUND OF THE INVENTION

Individual iron club heads in a set typically increase progressively in face surface area and weight as the clubs progress from the long irons to the short irons and wedges. Therefore, the club heads of the long irons have a smaller face surface area than the short irons and are typically more difficult for the average golfer to hit consistently well. For conventional club heads, this arises at least in part due to the smaller sweet spot of the corresponding smaller face surface area.

To help the average golfer consistently hit the sweet spot of a club head, many golf clubs are available with cavity-back constructions for increased perimeter weighting. Perimeter weighting also provides the club head with higher rotational moment of inertia about its center of gravity. Club heads with higher moments of inertia have a lower tendency to rotate caused by off-center hits. Another recent trend has been to increase the overall size of the club heads, especially in the long irons. Each of these features increases the size of the sweet spot, and therefore makes it more likely that a shot hit slightly off-center still makes contact with the sweet spot and flies farther and straighter. One challenge for the golf club designer when maximizing the size of the club head is to maintain a desirable and effective overall weight of the golf club. For example, if the club head of a three-iron is increased in size and weight, the club may become more difficult for the average golfer to swing properly.

In general, the center of gravity of the cavity-back clubs is moved toward the bottom and back of the club head. This permits an average golfer to get the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456.

However, professional tour players and low handicap players, who can consistently hit the balls on the club's sweet spot, prefer muscle-back type clubs for the visual effect of a smaller head and better workability. Workability is a function of the size of the club head, the center gravity being closer to the hosel axis, the thinner sole and the reduced offset between the hosel and the hitting face. Workability is the ability to shape the shots and to control the trajectory's height.

Muscle-back clubs generally have lower inertia and higher center of gravity than cavity-back clubs. Muscle-back clubs, such as Kenneth Smith's Royal Signet clubs and Mizuno's MP-33 irons concentrate the club's weight near the sweet spot, thereby reducing its inertia. Also since the club's weight is not moved to the perimeter or to the sole, the conventional muscle-back club does not have as large a sweet spot or low center of gravity as the cavity-back club. Some of the commercially available muscle-back clubs are using multiple materials to change the mass properties. For example, the Bridgestone EC603 Pro iron clubs have a stainless steel body with a heavy tungsten insert in the lower portion of the back of the club (i.e., in the muscle portion of the club), and a urethane insert for vibration damping. Similarly, the Bridgestone Tanbec TB-2 has a titanium body and a heavy beryllium copper insert in the lower portion of the back of the club. However, these heavy inserts reduce the inertia of the club.

Hence, there remains a need for muscle-back clubs that have improved mass properties, such as higher inertia and better location of the center of gravity.

SUMMARY OF THE INVENTION

The present invention relates to muscle-back iron golf clubs that have improved mass properties, such as lower center of gravity and higher moments of inertia.

The present invention also relates to muscle-back golf clubs that have their mass redistributed to gain higher moments of inertia and lower the center of gravity while maintaining or improving workability.

The present invention also relates to a method of making golf clubs from various materials.

DETAILED DESCRIPTION OF THE PREFERRED EMBODIMENTS

Figure 1:
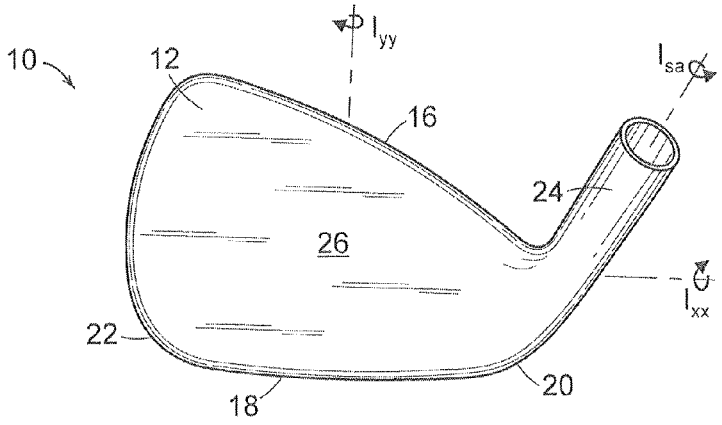
FIG. 1 is a front view of an iron-type golf club illustrating the definitions for the various moments of inertia.
Figure 2:
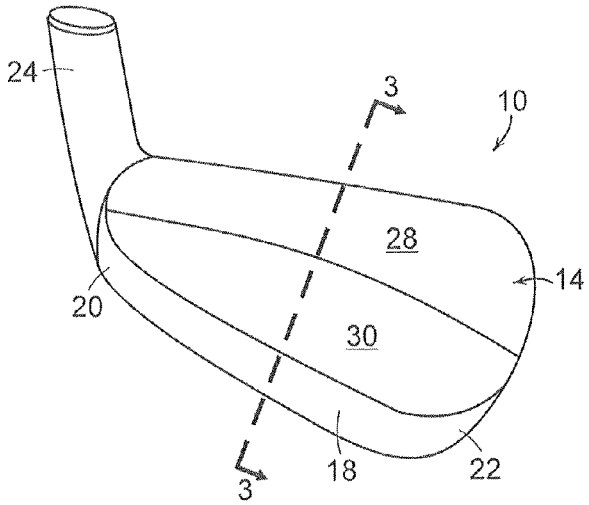
FIG. 2 is an elevational view of an inventive muscle-back iron club.
Figure 3:
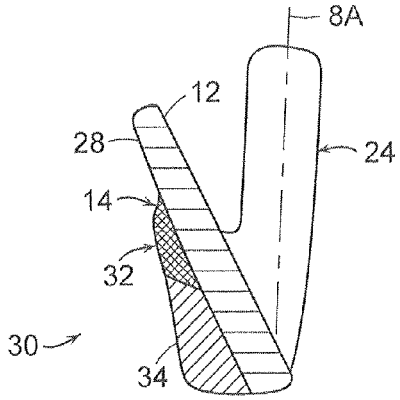
FIG. 3 is a cross-sectional view of the inventive club of FIG. 2 along line 3-3.

Rotational moments of inertia (inertia) in golf clubs are well known in art, and are fully discussed in many references, including U.S. Pat. No. 4,420,156, which is incorporated herein by reference in its entirety. When the inertia is too low, the club head tends to rotate about an axis excessively from off-center hits. Higher inertia indicates higher rotational mass and less rotation from off-center hits, thereby allowing off-center hits to fly farther and closer to the intended path. Inertia is measured about a vertical axis going through the center of gravity (c.g.) of the club head ($I_{yy}$), and about a horizontal axis through the c.g. of the club head ($I_{xx}$), as shown in FIG. 1. Although not shown, rotational inertia about the z-axis ($I_{zz}$) is measured about the axis orthogonal to both the x- and y-axis. The tendency of the club head to rotate around the y-axis through the c.g. indicates the amount of rotation that an off-center hit away from the y-axis causes. Similarly, the tendency of the club head to rotate around the x-axis through the c.g. indicates the amount of rotation that an off-center hit away from the x-axis through the c.g. causes. Most off-center hits cause a tendency to rotate around both the x and y axes. High $I_{xx}$ and $I_{yy}$ reduce the tendency to rotate and provide more forgiveness to off-center hits.

Inertia is also measured about the shaft axis ($I_{sa}$), shown in FIG. 1. First, the face of the club is set in the address position, then the face is squared and the loft angle and the lie angle are set before measurements are taken. Any golf ball hit has a tendency to cause the club head to rotate around the shaft axis. High $I_{sa}$ reduces the tendency to manually rotate the face open or closed, thus reducing shot control or ball flight workability. High $I_{xx}$ and $I_{yy}$ can be readily achieved in cavity-back iron-type clubs due to the mass/weight of the clubs being moved to the perimeter and the sole, thereby shifting the c.g. This can now be realized in high-end muscle-back irons by improving mass properties of the club in accordance with the present invention.

As shown in FIGS. 1-6, an inventive muscle-back club head 10 comprises front 12, back 14, crown 16 and sole 18. Club head 10 also has heel 20 and toe 22 with hosel 24 connected to the club proximate heel 20. The club also forms hitting face 26 on front 12 to impact golf balls. As more clearly shown in FIGS. 2 and 3, back 14 has upper portion 28 and lower portion or muscle portion 30, and muscle portion 30 is relatively thicker than upper portion 28. Muscle portion 30 may include the c.g. of the club head, or when the c.g. is located aft of the club head, it is closer to the thick muscle portion 30 than to thin upper portion 28 of back 14.

In accordance with the present invention, muscle portion 30 is made separate from front 12 and hosel 24 and may contain lightweight insert or chip 32 and heavyweight cradle 34. In a preferred embodiment, front 12 and hosel 24 are made of the same or similar material and integral with each other. Front 12 and hosel 24 can be made by forging or metal casting, and each has a density that is higher than the density of lightweight chip 32 and is lower than the density of heavyweight cradle 34. In one example, hosel 24 and face 12 are made from stainless steel or carbon steel (density of about 8 g/cc) or titanium (density of about 4.5 g/cc); chip 32 is made from aluminum (density of about 2.7 g/cc) or polymers (density of about 1-1.5 g/cc); and cradle 34 is made from tungsten or tungsten alloy (density of about 11-19 g/cc). The densities and volumes of the components are selected so that the overall size and shape of the inventive clubs are similar to conventional muscle-back clubs preferred and accepted by tour and low handicap players. It will be appreciated that other suitable materials can be used so long as the relative densities satisfy the requirements above.

Figure 4:
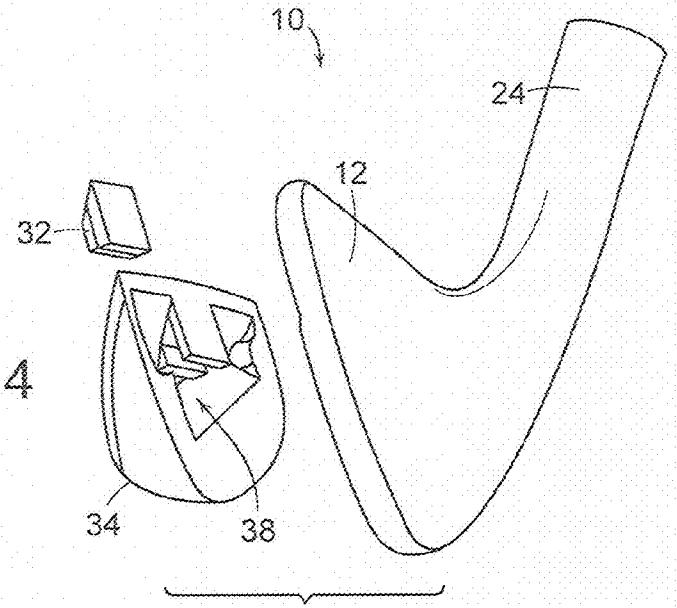
FIG. 4 is an exploded view of the inventive muscle-back iron club.
Figure 6:
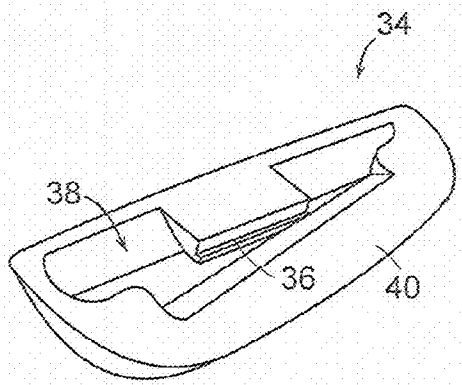
FIG. 6 is an elevational view of a cradle shown in FIGS. 4 and 5.
Figure 5:
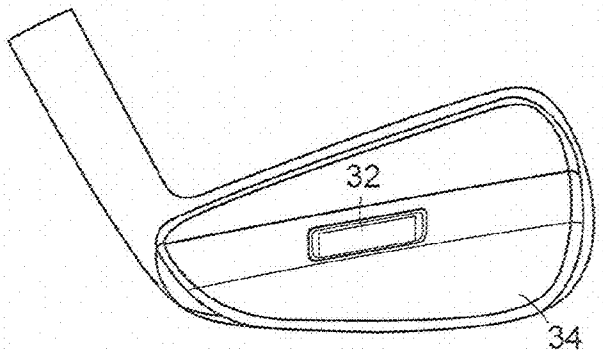
FIG. 5 is the back side view of the club of FIG. 4.

FIGS. 4-6 show that cradle 34 has pocket 36 adapted to receive chip 32. Cradle 34 may also contain optional void/space 38. Void 38 removes material from cradle 34 to allow the c.g. of the club head to be shifted aft of hitting face 26 in order to enlarge the sweet spot of the club. Void 38 also allows the impact to produce a sound indicating that the ball was well struck.

Cradle 34 can be attached to front 12 by laser welding the perimeter of cradle 34 to the back of front 12. The attachment of cradle 34 to front 12 can also be accomplished by other methods, such as co-forging, described below, or by screws or rivets or epoxy. Chip 32 can be attached to pocket 36 by interference fit, epoxy, screw(s), adhesive, etc. or a combination thereof.

In inventive club head 10, some of the mass has been shifted away from the geometric center by the placement of lightweight chip 32 proximate to the geometric center of front 12. Also, some of the mass has been shifted aft and toward the bottom of the club by cradle 34, which as illustrated has a thicker bottom 40, which forms sole 18 and void 38. The deployment of mass has moved the e.g. aft and lower and has increased inertia ($I_{sa}$, $I_{xx}$ and $I_{yy}$) to be more forgiving with mishits and to provide higher trajectory, similar to a cavity-back club.

This combination of multiple materials provides a club with improved mass properties, i.e., more forgiving of mishits and higher trajectory in a club head with size, shape, and proportion more traditional and more acceptable to tour players and low handicap players. The combination of these materials, e.g., stainless/carbon steel hosel 24 and hitting face 26, aluminum chip insert 32 and tungsten/tungsten alloy cradle 34 permits the club head geometry to remain substantially the same as that of a single material club, but features improved mass properties.

Figure 7:
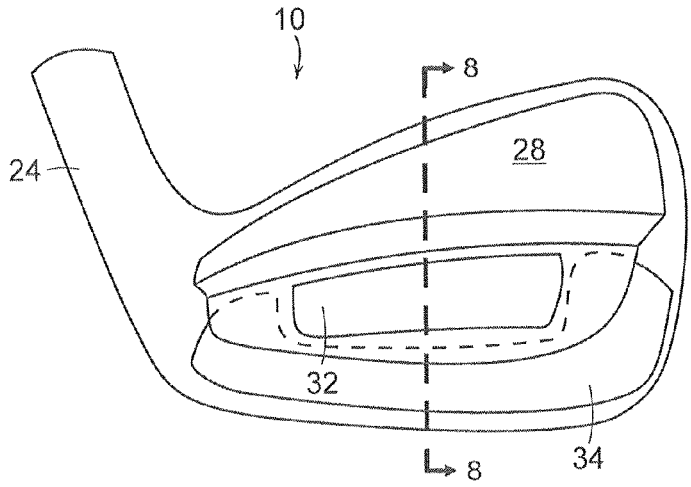
FIG. 7 is the back side view of another inventive muscle-back iron club.
Figure 8:
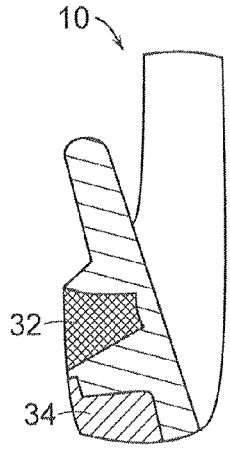
FIG. 8 is a cross-sectional view of the club of FIG. 7 along line 8-8.
Figure 9A:
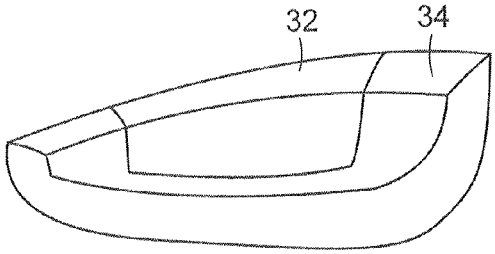
FIGS. 9(*a*)-(*d*) are other embodiments of the cradle and insert.
Figure 9C:
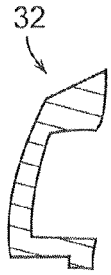
Figure 9D:
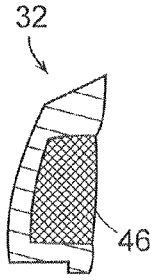
Figure 9B:
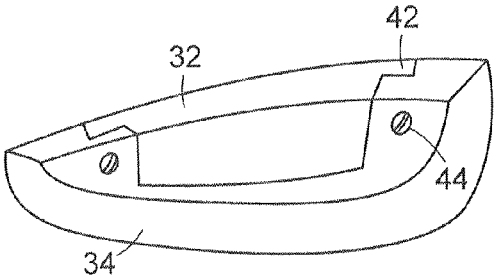

FIGS. 7-9 illustrate other embodiments of front 12, chip 32 and cradle 34. Chip 32 may be substantially longer and have the shape of an elongated bar and cradle 34 may not be designed to receive chip 32. Instead, both chip 32 and cradle 34 are attached directly to the back of front 12, which has pockets sized and dimensioned to receive these two elements, as shown in FIG. 8. These components can be attached via laser welding, screw(s), co-forging or any known methods. Alternatively, FIG. 9(*a*) shows that cradle 34 can have a "U" shape and is sized and dimensioned to receive chip 32 in the cavity created by the "U" shape. Furthermore, chip 32 in the elongated form can be attached to cradle 34 by tongue and groove 42 and/or by screw(s) 44, as shown in FIG. 9(*b*). FIGS. 9(*c*)-(*d*) show that chip 32 can be hollow to change the quality of the sound of the impact with golf balls or can be filled with yet another material 46, such as a vibration dampener, e.g., plastic, urethane or rubber, or with high or low density materials, such as aluminum, titanium, magnesium, carbon fiber, Kevlar®, etc. Material 46 allows customization of the clubs to the player's individual needs.

The inertia of the inventive clubs, e.g., the club shown in FIGS. 4-6, was compared to conventional single material muscle-back clubs, such as the muscle back iron-type golf clubs available from Titleist®, as shown in Table 1 below.

TABLE 1

Center of Gravity and Moments of Inertia

| | Inventive 3-Iron | MB club A 3-iron | MB club B 3-iron | Inventive 6-Iron | MB club A 6-iron | MB club B 6-iron | Inventive 9-Iron | MB club A 9-iron | MB club B 9-iron |
|---|---|---|---|---|---|---|---|---|---|
| CG Ground Y (mm) | 18.6 | 19.0 | 19.8 | 18.6 | 18.7 | 19.9 | 18.8 | 19.0 | 19.6 |
| CG Shaft Axis (mm) | 33.5 | 34.3 | 32.1 | 34.0 | 34.8 | 31.7 | 34.0 | 35.0 | 32.9 |
| CG Depth Z (mm) | 6.0 | 6.0 | 5.2 | 8.2 | 7.7 | 7.6 | 10.7 | 11.3 | 10.1 |
| Inertia CG X | 47.3 | 43 | 45 | 55.3 | 49.2 | 54.1 | 69.5 | 65.1 | 71.8 |
| Inertia CG Y | 204.4 | 190 | 189 | 222.1 | 198.9 | 207 | 254.2 | 226.9 | 241.5 |
| Inertia CG Z | 240.1 | 223 | 225 | 255.0 | 227.3 | 240.6 | 280.3 | 246.7 | 267.6 |
| Inertia Total X + Y + Z | 318.9 | 296 | 297 | 342.6 | 306 | 322 | 384.7 | 341 | 368 |
| Inertia Hosel Axis | 423.3 | 435 | 387 | 484.4 | 485.8 | 427.4 | 548.5 | 537 | 512.1 |

For the inventive 3-iron, the c.g. in the vertical y-direction and aft or z-direction is lower than the two comparative 3-iron clubs, and the c.g. in the shaft axis is in between the two comparative clubs. This data shows that the c.g. of the inventive 3-iron club is indeed lower and more aft than the single material conventional 3-iron clubs. The data also shows that the c.g. in the shaft axis, which measures how far the c.g. is away from the shaft or hosel axis, is comparable to those of the conventional clubs. As discussed above, the closeness of the c.g. to the shaft axis indicates better workability. In other words, the inventive 3-iron is more forgiving due to better c.g. in the vertical and aft directions and has comparable workability to the comparative clubs.

The rotational inertia about the x, y and z axes and the aggregate inertia are higher than those of the two comparative clubs to reduce the tendency of the club head to rotate from mishits, and the inertia about the shaft axis for the inventive club is between those of the two comparative clubs indicating comparable workability.

The data for the inventive 6-iron club compared to the conventional 6-irons is similar to that of the inventive 3-iron club compared to the conventional 3-irons, as discussed above.

The data for the inventive 9-iron shows that the c.g. in the vertical direction is indeed lower and the c.g. in the shaft axis remains comparable to the conventional clubs, but the c.g. in the aft direction for the inventive club is only comparable to the conventional clubs, i.e., between the two conventional clubs. The inertia for the inventive 9-iron is higher in the y- and z-axis and aggregate inertia is better or higher than the conventional clubs, but the inertia about the x-axis is only higher than one of the two conventional clubs. The inertia about the shaft axis is higher than the conventional muscle-back clubs.

It can be concluded from the above data that the inventive clubs enjoy better c.g. location and higher inertia while maintaining comparable workability, especially in the long and mid-irons, where the shots are harder to make. The inventive iron clubs, such as those shown in FIGS. 4-6 and described above, can be made with the following materials and proportions.

| Parts | Materials | Volume Percent |
|---|---|---|
| Hosel 24 and Front 12, including hitting face 26 | Stainless steel | 48-77% |
| Chip 32 | Aluminum | 1-6% |
| Cradle 34 | Tungsten | 51-17% |

The weight of the iron-type clubs varies throughout the set, e.g., 236, 242, 248, 254, 267, 268, 275, 283, and 287 grams for 2-iron to pitching wedge, respectively. In one embodiment, the materials and volumes should be selected so that the final weight of each club meets these selected weight for each club.

Figure 25:
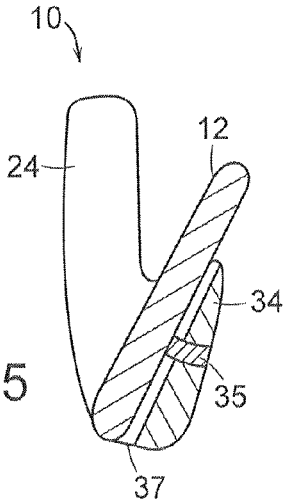
FIG. 25 is a cross-sectional view of another embodiment of the present invention.

FIG. 25 shows another embodiment of the inventive club. This embodiment is similar to the embodiment of FIG. 3-6, in that hosel 24 and front 12, which has a substantially uniform thickness, are formed integral to each other by forging or metal casting. Cradle 34 in this embodiment does not contain any void or pocket and is attached to front 12 via post 35. Cradle 34 forms the lower muscle portion of club 10. Post 35 may be made integral to front 12 or made integral to cradle 35. Post 35 may be made separately and acts like a rivet to connect front 12 to cradle 35. Post 35 may also be a threaded screw. One or more posts 35 may be used. Preferably, post 35 is made integral to front 12, and cradle 34 has a corresponding hole sized to receive the post. The head of post 35 protrudes beyond the outer surface of cradle 34 and is flattened to affix cradle 34 to front 12, similar to affixing by rivets. Additionally, a vibration dampening layer 37 can be positioned between front 12 and cradle/muscle 34 to reduce the vibrations caused by impacts with golf balls. This vibration damping layer is generally lighter than steel, which causes the c.g. to move aft, further assisting the trajectory height.

In this embodiment, hosel 24 and front 12 are made from stainless steel, carbon steel, titanium or other conventional metals. Cradle 34 is preferably made from a high density metal, such as tungsten or tungsten nickel or tungsten nickel copper. Dampening layer 37 can be made from any polymeric material that can absorb vibrations, such as rubber, elastomers, urethane or nylon. Nylon is useful because it can be polished along with metals. Dampening layer 37 may also be pre-stressed, i.e., be compressed between cradle 34 and front 12, to keep the connection between front 12 and cradle 34 a tight fit, such as by a mechanical lock, and minimizes relative movements between front 12 and cradle 34.

Figure 10:
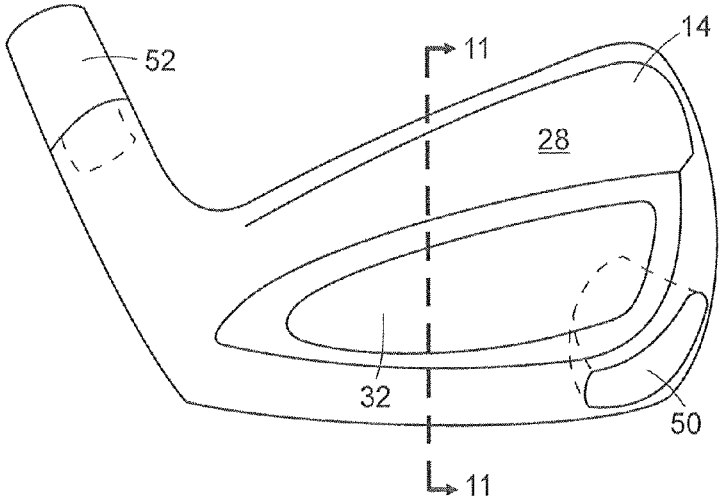
FIG. 10 is the back side view of another inventive high rotational inertia muscle-back iron club.
Figure 11:
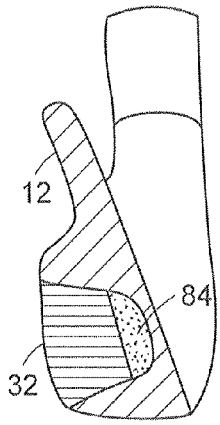
FIG. 11 is a cross-sectional view of the club of FIG. 10 along line 11-11.
Figure 12:
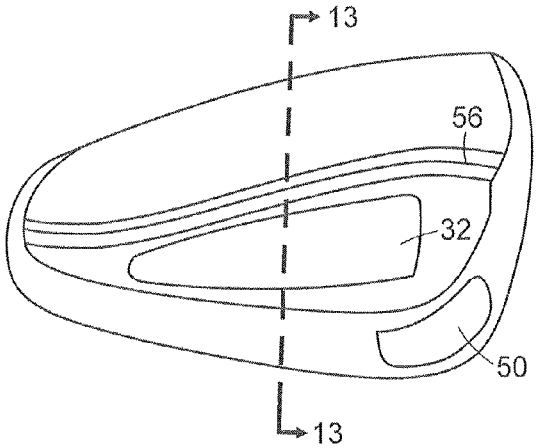
FIG. 12 is another embodiment of the inventive muscle-back portion of the club.
Figure 13:
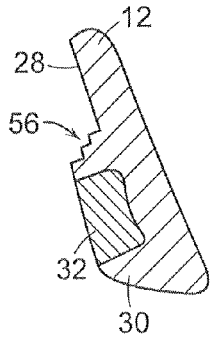
FIG. 13 is a cross-sectional view of the club of FIG. 12 along line 13-13.

To further improve or increase the rotational inertia of the inventive clubs while maintaining workability, heavyweight inserts can be positioned on opposite sides of the c.g. or of the geometric center, or on opposite sides of a vertical line going through the c.g. or geometric center. As shown in FIG. 10, club 10 has heavyweight toe insert 50 and heavyweight hosel collar 52. These inserts are located on opposite corners of club 10 and are located as far apart as practicable to increase rotational inertia. Additionally, since hosel collar 52 is proximate to the hosel axis, the c.g. of the club is maintained relatively close to the hosel axis to preserve as much as possible the workability of the club. To balance or counter heavyweight inserts 50, 52, lightweight chip 32 is provided as discussed above. As shown in FIG. 11, an optional dampener 54 can be provided, where the dampener is made from a polymeric material such as urethane or rubber. Back 14 of club 10 may also have other geometries, as well as other shapes for lightweight chip 32, including steps 56 separating upper back portion 28 and muscle portion 30.

Figure 14:
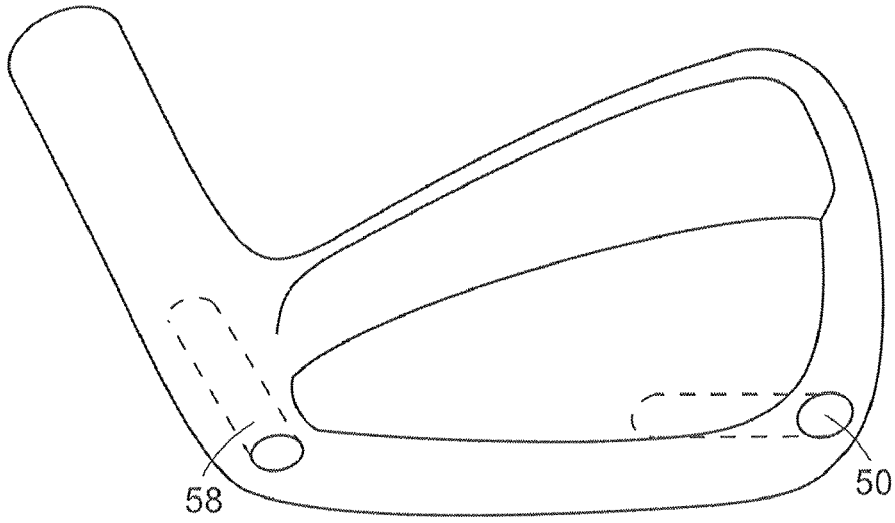
FIG. 14 is a back side view of another high rotational inertia muscle-back iron club.
Figure 15:
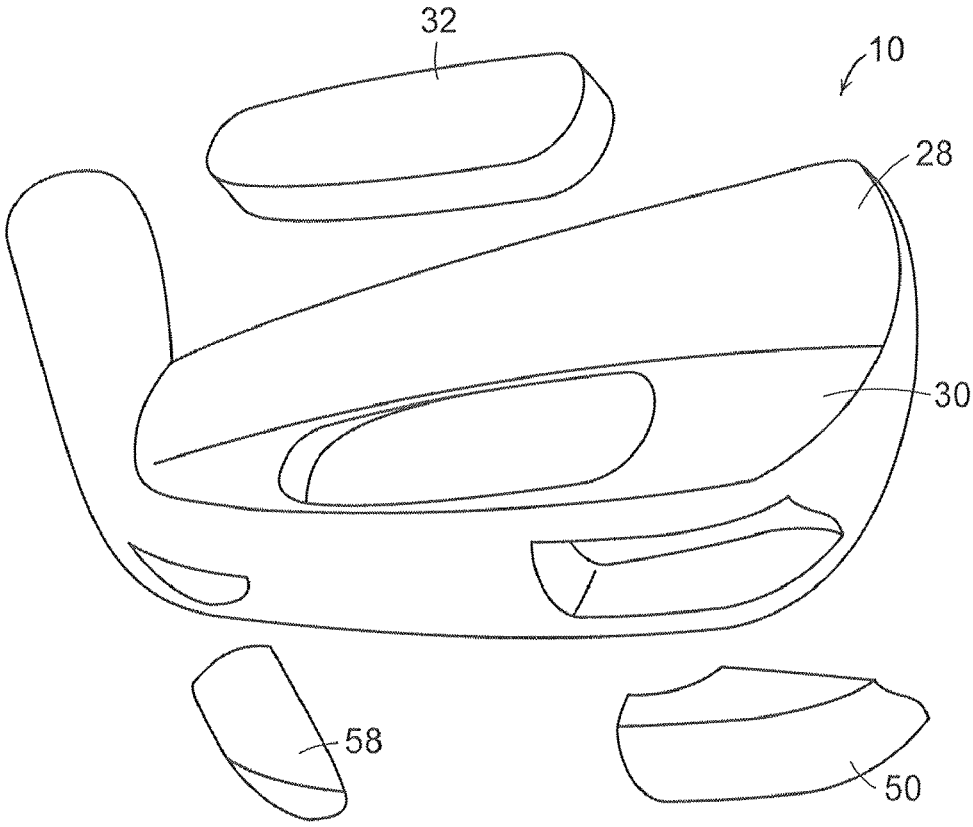
FIGS. 15-16 are exploded views of other embodiments of high rotational inertia muscle-back iron clubs.
Figure 16:
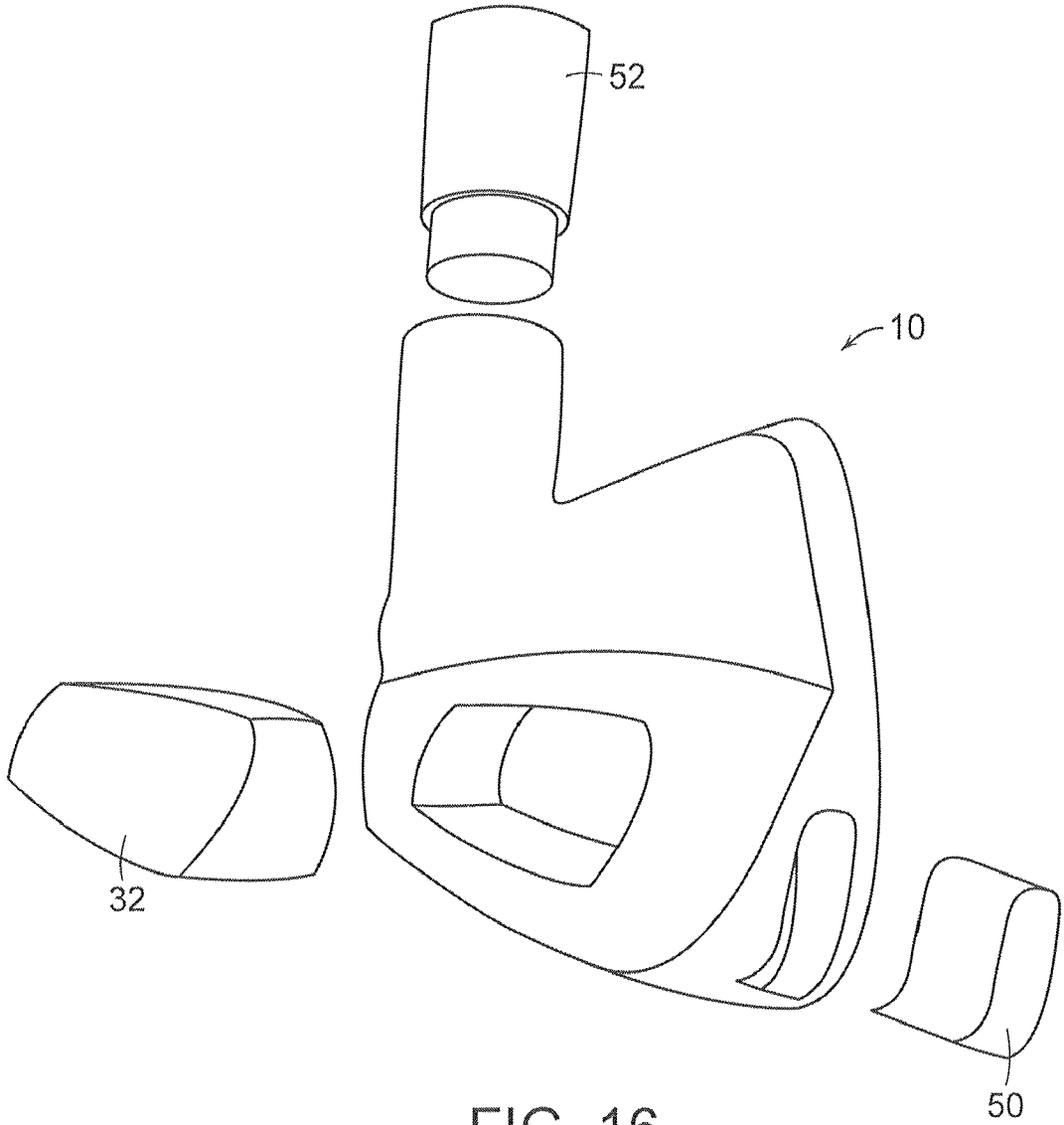

To maintain the c.g. as low to the ground as possible, heavyweight hosel collar 52 can be replaced by heavyweight heel pin 58 to balance toe insert 50 shown in FIG. 14. Since heel pin 58 is positioned lower than hosel collar 52, the c.g. is kept low. Alternatively, hosel collar 52, heel pin 58 and toe insert 50 can be used together. Heel pin 58, hosel collar 52, toe insert 50 and chip 32 can have other shapes and dimensions as shown in FIGS. 15 and 16, so long as their respective densities allow club 10 to resemble the traditional muscle-back irons in size, weight and dimensions accepted by tour players and low handicap players.

Figure 18:
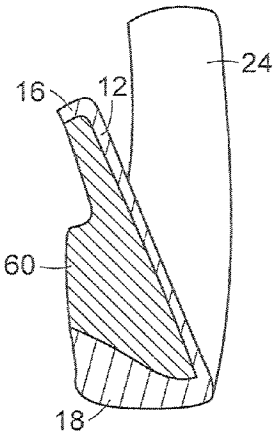
FIG. 18 is a cross-sectional view of the club of FIG. 17 along line 18-18.
Figure 17:
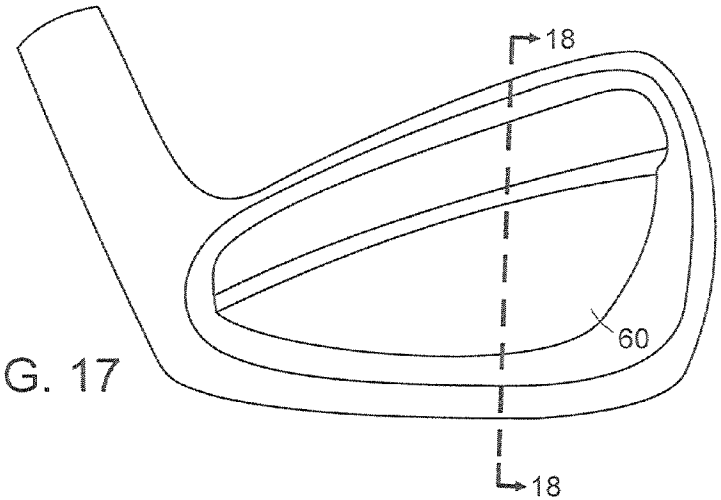
FIG. 17 is yet another embodiment of the inventive muscle-back club showing a relatively large lightweight back section.
Figure 19:
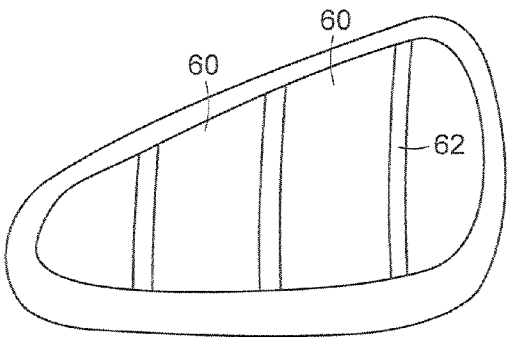
FIG. 19 is another embodiment of the muscle-back of FIG. 17.

FIGS. 17 and 18 show another embodiment of the inventive muscle-back club. In this embodiment, most of the back portion, including most of upper back portion 28 and muscle portion 34, is made from a single piece of lightweight material, such as aluminum or magnesium. As shown, back insert 60 comprises an upper back and a muscle-back portion. The sole can be made from the same material as front 12 and hosel 24. Front 12 and hosel 24 can be forged. Back insert 60 can be made by casting or forging and then affixed to the back of front 12 by laser welding or screws/rivets. Crown 16 can be from the top edge of front 12 bent down and over the top of back insert 60. Sole 18 can be made integral with front 12 and hosel 24, by forging or casting, if these three parts are made from the same material. Alternatively, sole 18 can be made from a relatively denser material, such as tungsten or tungsten alloys, and can be made separately and attached to back insert 60 and front 12, via laser welding, screws/rivets, adhesive or the like. This construction allows the c.g. to be shifted aft and down. Also, this construction allows front 12, which is relatively thin, to flex due to differences in the coefficient of thermal expansion between the different materials. Alternatively, back insert 60 can be separated into smaller parts separated by ribs 62, which are made from the same material as front 12, as shown in FIG. 19.

The embodiment of FIGS. 17 and 18 can be made by pouring molten magnesium or aluminum into a pre-heated cavity back iron, which then becomes a muscle back via molding or CNC machining process. The cavity back head is heated up to a temperature that relieves the difference in thermal coefficient of expansion and shrink rate, such that the pieces fit snugly together, possibly in an interference fit.

In another embodiment of the present invention, the mass properties of the muscle-back clubs vary from the long irons to the short irons and wedges. In general, in the long irons, the weights are shifted or moved toward the sole, heel and/or toe. Preferably, the long irons include one or more heavy inserts in the toe region to keep the c.g. near the hosel axis for better workability. The mid-irons may include a heavy hosel collar and a toe insert, and an optional heel insert. The short irons and wedges would have a lightweight heel insert and possibly a heavy crown insert. All these clubs would have lightweight chip 32 positioned in the muscle portion 30 of the clubs, as described above. These various combinations allow the golf club designers multiple degrees of freedom to customize a set of forgiving muscle-back clubs to a player's particular needs.

Figure 20:
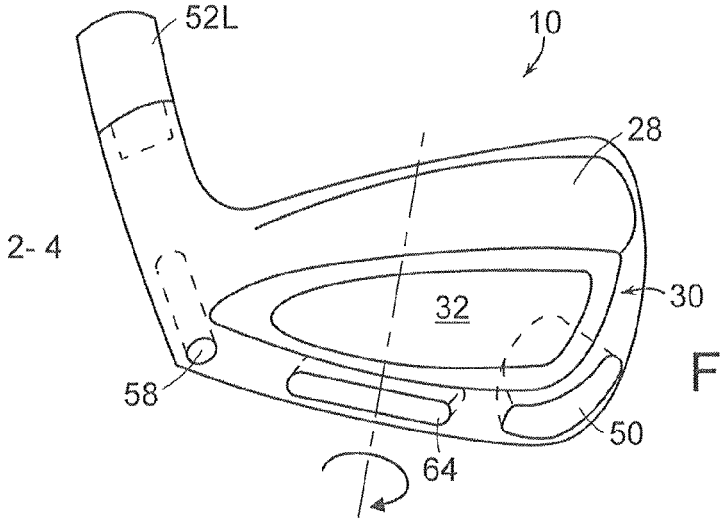
FIGS. 20-22 are elevational views of a set of iron-type golf clubs with progressing mass properties in accordance with the present invention.
Figure 21:
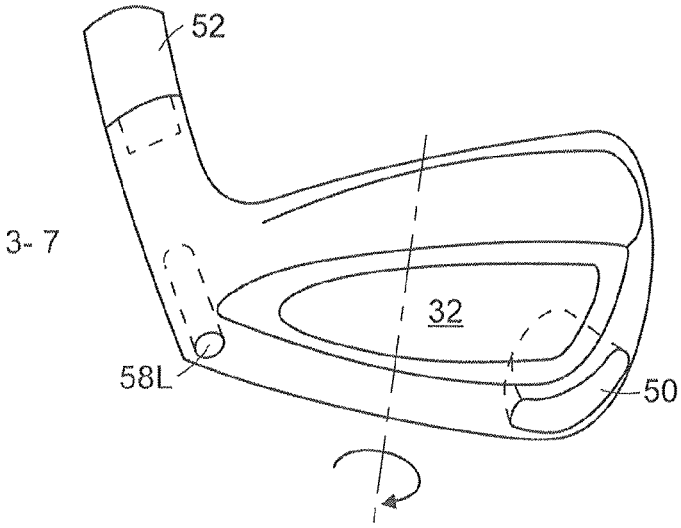
Figure 22:
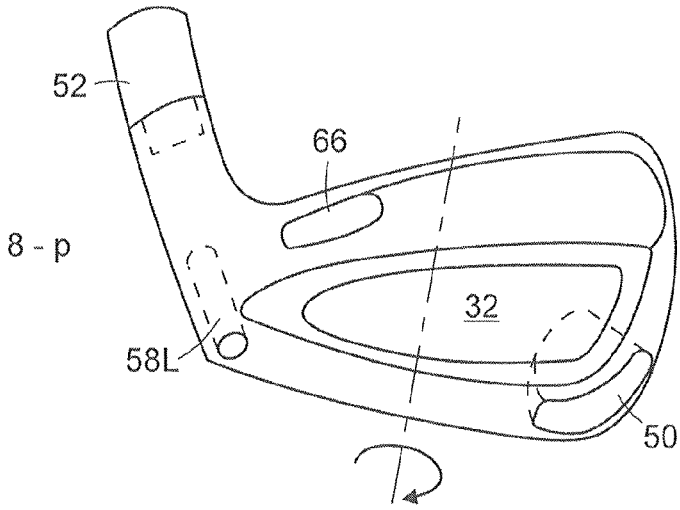
Figure 23A:
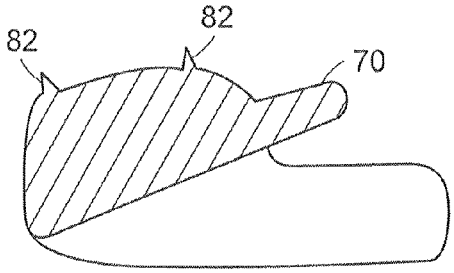
FIGS. 23(*a*)-(*e*) are cross-sectional views showing the representative steps of a co-forging process suitable for making the iron-type clubs in accordance with the present invention.
Figure 23B:
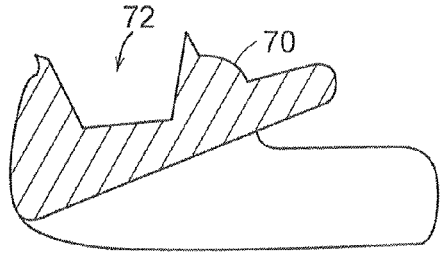
Figure 23C:
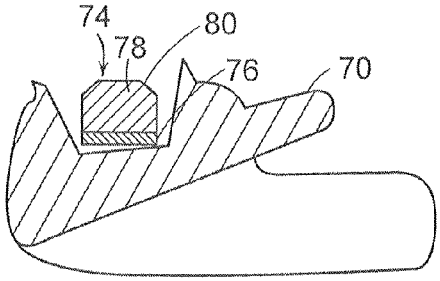
Figure 23D:
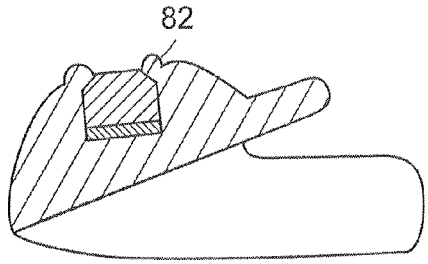
Figure 23E:
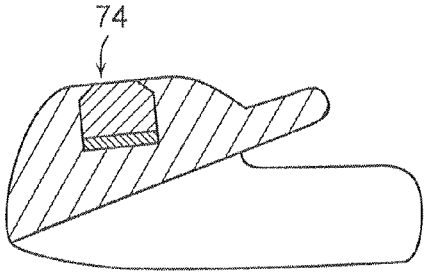
Figure 24A:
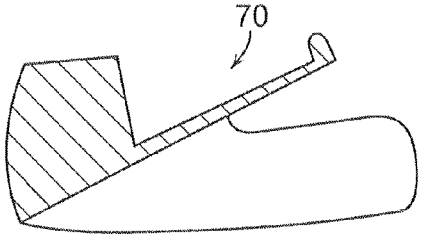
FIGS. 24(*a*)-(*d*) are cross-sectional views showing the representative steps of a forging/swaging process for pre-loading an insert into an iron club suitable for making the iron-type clubs in accordance with the present invention.
Figure 24C:
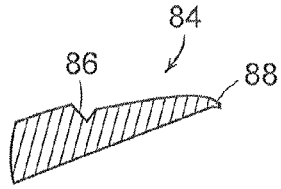
Figure 24B:
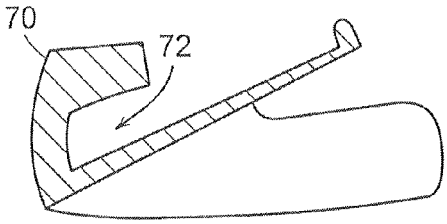
Figure 24D:
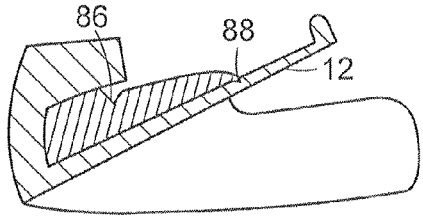

In one example, as shown in FIGS. 20-22, the long iron versions, e.g., the 2-iron to the 4-iron, club 10 has lightweight chip 32 positioned in the muscle portion 30 of the clubs. However, these long-irons would have lightweight hosel collar 52L, heavyweight toe insert 50, heavyweight sole insert 64, and heavyweight toe insert 58. These long irons would have high rotational moments of inertia and low c.g. The mid-irons, e.g., the 5-iron to 7-iron, would have heavyweight hosel collar 52 and heavyweight toe insert 50 for increased inertia, and lightweight heel insert 58 and lightweight chip 32 for selective placement of c.g. These mid-irons would have mid-range inertia and mid-range c.g. The short irons, e.g., the 8-iron to the wedges, still have would have heavyweight hosel collar 52 and heavyweight toe insert 50 for increased inertia and lightweight heel insert 58 and lightweight chip 32 for selective placement of c.g. These short irons would also have a heavyweight crown insert 66 to keep the c.g. relatively high. The short irons would have low to mid-inertia and higher c.g.

The lightweight and heavyweight inserts can be placed at multiple locations in the club head to achieve a desired result, and the present invention is not limited to any particular combinations shown herein.

As mentioned above, club heads in accordance with the present invention can be made by co-forging as illustrated in FIGS. 23(*a*)-(*e*), in addition to conventional manufacturing techniques including any of those described above. A forging process comprises a number of forging steps, typically 2 to 7 steps. In co-forging, the forging process is stopped at a certain stage after a rough workpiece 70 that roughly resembles the final product is formed, as shown in FIG. 23(*a*), which in this case is a muscle-back iron. The forging process is preferably interrupted at this point, and a cavity 72 is machined into workpiece 70, for example by a computer numerically controlled machine (CNC), as shown in FIG. 23(*b*). An insert 74 is then placed into cavity 72, as shown in FIG. 23(*c*). Cavity 72 is sized and dimensioned to wrap around insert 74 without leaving any significant void between the insert and the workpiece after the process is completed. Insert 74 can be a heavyweight or lightweight insert, discussed above, and insert 74 may comprise multiple materials, such as a polymeric dampener 76 for vibration dampening and a lightweight chip 78 for altering mass properties. Preferably, insert 74 has rounded-off or chamfered shoulders 80, and workpiece 70 has matching protrusions 82. When insert 74 is positioned within cavity 72, the forging process continues and the material of workpiece 70 is hammered down over insert 72, as shown in FIG. 23(*d*). The material from protrusion 82 is designed to fit on top of chamfered shoulders 80 to mechanically lock the insert within the workpiece, which becomes a muscle-back club, as shown in FIG. 23(*e*). When a polymeric dampener 76 is included in insert 74, preferably swaging steps are used to avoid melting the dampener. Swaging is a known metal-forming technique in which the metal is plastically deformed to its final shape using high pressures. Swaging is similar to forging, except that the metal is cold worked or warm work.

Another method for attaching the inserts, such as chip 32 to the club head is by swaging and preloading, as shown in FIGS. 24(*a*)-(*d*). First a rough workpiece 70 is forged or cast and a cavity 72 is cut from the workpiece, as shown in FIG. 24(*a*)-(*b*) similar to the co-forging process described above. Next, insert 84 is formed by any known process. Insert 84 has a lock grove 86 and rib 88 and is machined to fit into cavity 72. Workpiece 70 is then cold worked or swaged, e.g., by bending, to form a single joint or part. During this swaging step, insert 84 is preloaded when rib 88 is pressed against the back of front 12 of the club and insert 84 slightly bends at lock grove 86. This bending force conforms insert 84 to cavity 72 and pre-stresses insert 84. This pre-loading reduces the noise made between these two parts during dynamic loadings or impacts, and compensates for any loose fit, such as thermal expansions or tolerances of the two different metals.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and Hembodiments, which would come within the spirit and scope of the present invention.

We claim:

1. An iron-type golf club, comprising:

a hosel;

a front wall including a hitting face;

a back portion; and a lightweight insert, wherein the back portion comprises only an upper blade portion and a lower muscle portion, said entire upper blade portion being defined as a non-perimeter weighted blade-type iron structure from a top end to a bottom end of the upper portion, said muscle portion extending from the upper blade portion and being substantially thicker than the upper blade portion, wherein the golf club further comprises at least two heavyweight inserts having higher density than a density of the front wall and a density of the back portion, wherein the heavyweight inserts are located on heelward and toeward sides of the geometric center of the hitting face, the lightweight insert having a density lower than the density of the front wall and the density of the back portion, wherein the lightweight insert is positioned only within the muscle portion.

2. The golf club of claim 1, wherein one of the heavyweight inserts is located proximate to the shaft axis.

3. The golf club of claim 2, wherein said heavyweight insert is a hosel collar.

4. The golf club of claim 2, wherein said heavyweight insert is a heel insert.

5. The golf club of claim 2, wherein one of the other heavyweight inserts is a toe insert.

6. The golf club of claim 1 further comprising a lightweight insert having a density lower than the density of the front wall and the density of the back portion, wherein the lightweight insert is positioned within the heel of the golf club.

7. The golf club of claim 1 further comprising a third heavyweight insert located proximate to a crown of the golf club.

* * * * *